US005985138A

United States Patent [19]

Humphreys

[11] Patent Number: 5,985,138

[45] Date of Patent: Nov. 16, 1999

[54] TAR SANDS EXTRACTION PROCESS

[75] Inventor: Reginald D. Humphreys, Edmonton, Canada

[73] Assignee: Geopetrol Equipment LTD., Edmonton, Canada

[21] Appl. No.: 09/056,694

[22] Filed: Apr. 8, 1998

[30] Foreign Application Priority Data

Jun. 26, 1997 [CA] Canada ..... 2208767

[51] Int. Cl.[6] ..... C10G 1/04

[52] U.S. Cl. ..... 208/391; 208/390

[58] Field of Search ..... 208/390, 391

[56] References Cited

U.S. PATENT DOCUMENTS

| | | | |
|---|---|---|---|
| 3,951,778 | 4/1976 | Willard, Sr. . | |
| 4,120,777 | 10/1978 | Globus . | |
| 4,929,341 | 5/1990 | Thirvmalachar et al. . | |
| 4,968,413 | 11/1990 | Datta et al. . | |
| 5,626,743 | 5/1997 | Humphreys . | |
| 5,770,049 | 6/1998 | Humphreys | 208/391 |

OTHER PUBLICATIONS

Energy Resources Conservation Board, Alternative Bitumen Extraction Technologies for Mined Oil Sands, Aug. 30, 1982.

Stone, J.A., Hyndman, A.W., Clarke, J.E., Oil Sands Extraction: A Dynamic Technology, Session 2, Paper No. 6, U.S. Application 08/719,513.

*Primary Examiner*—Helane Myers
*Attorney, Agent, or Firm*—Bennett Jones

[57] ABSTRACT

A hot water extraction process for extracting bitumen from tar sands is taught wherein the tar sand is conditioned using an alkali metal bicarbonate, an alkali metal carbonate and a liquid hydrocarbon. A source of calcium and/or magnesium ions can also be added. The conditioning step replaces the step of conditioning using caustic soda previously used in tar sand extraction. The use of the alkali metal bicarbonate and carbonate and a liquid hydrocarbon substantially eliminates the production of sludge in tar sand extraction and maintains or improves bitumen recovery. The process allows for hot conditioning solution to be recycled to the process by use of a recycle storage tank.

30 Claims, 3 Drawing Sheets

TAR SANDS EXTRACTION PROCESS

FIELD OF THE INVENTION

The present invention is directed toward a tar sands extraction process and, in particular, a hot water extraction process for tar sands and a conditioning solution for use therein.

BACKGROUND OF THE INVENTION

Throughout the world, considerable oil reserves are locked in the form of tar sands, also called bitumen sands. The hot water extraction process is the standard process for recovering bitumen from the sand and other material in which it is bound. The bitumen is then treated to obtain a synthetic crude oil therefrom.

In the hot water extraction process using existing extraction facilities, tar sand is first conditioned in large conditioning drums or tumblers with the addition of caustic soda (sodium hydroxide) and hot water at a temperature of about 180° F. The nature of these tumblers is well known in the art. The tumblers have means for steam injection and further have retarders, lifters and advancers which create violently turbulent flow and positive physical action to break up the tar sand and mix the resultant mixture vigorously to condition the tar sands. This causes the bitumen to be aerated and separated to form a froth.

The mixture from the tumblers is screened to separate the larger debris and is passed to a separating cell where settling time is provided to allow the aerated slurry to separate. As the mixture settles, the bitumen froth rises to the surface and the sand particles and sediments fall to the bottom to form a sediment layer. A middle viscous sludge layer, termed middlings, contains dispersed clay particles and some trapped bitumen which is not able to rise due to the viscosity of the sludge. The froth is skimmed off for froth treatment and the sediment layer is passed to a tailings pond. The middlings is often fed to a second stage of froth floatation for further bitumen froth recovery. The water/clay residue from this second stage is combined with the sediment layer from the separating cell for disposal in the tailing ponds.

Recently, a modified hot water extraction process termed the hydrotransport system has been tested. In this system, the tar sand is mixed with hot water and caustic at the mine site and the resultant mixture is transported to the extraction unit in a large pipe. During the hydrotransport, the tar sand is violently mixed and aerated by turbulent flow and by injection of air at intermittent points along the pipe. As a result, the tar sand is conditioned and the bitumen is aerated to form a froth. This system replaces the manual or mechanical transport of the tar sands to the extraction unit and eliminates the need for tumblers.

The bitumen froth from either process contains bitumen, air, solids and trapped water. The solids which are present in the froth are in the form of clays, silt and some sand. From the separating cell the froth is passed to a defrother vessel where the froth is heated and broken to remove the air. Naphtha is then added to cause a reduction in the density of the bitumen, facilitating separation of the water and solids from the bitumen by means of a subsequent centrifuge treatment. The centrifuge treatment first includes a gross centrifuge separation followed by high speed centrifuge separations. The bitumen collected from the centrifuge treatment usually contains less than 2% water and solids and can be passed to the refinery for upgrading. The water and solids released during the centrifuge treatment are passed to the tailings pond.

The tailings in the tailing pond are largely a sludge of caustic soda, solids and water with some bitumen. During the initial years of residence time, some settling takes place in the upper layer of the pond, releasing some of the trapped water. The water released from the sludge can be recycled back into the hot water process. The major portion of the tailings remains as sludge indefinitely. The sludge contains some bitumen and high percentages of solids, mainly in the form of suspended silt and clay.

The tailings ponds are costly to build and maintain. The size of the ponds and their characteristic caustic condition creates serious environmental problems. In addition, environmental concerns exist over the large quantity of water which is required for extraction and which remains locked in the tailings pond after use.

It is known that sludge is formed in the initial conditioning of the tar sand, when the caustic soda attacks the silt and clay particles. The caustic soda causes the clays to swell and disburse into platelets. These platelets are held in suspension and form the gel-like sludge. Expanding-type clays such as the montmorillanite clays are particularly susceptible to caustic attack. Because of the problems caused by sludge formation and the low bitumen recovery available from highly viscous sludges, lower grade tar sands containing high levels of clays cannot be treated satisfactorily using the hot water extraction process.

The need exists for an extraction process which would result in a reduction or elimination of the production of sludge and therefore an increase in the water available for recycling. Any such process would also provide the possibility of increased bitumen recovery from medium and lower grade ores.

Also it is desirable that any tar sand extraction process should maintain or increase the present throughput possible by use of existing extraction processes and thereby not increase the cost of extraction. It is further desirable that a tar sand extraction process be of use in conventional extraction facilities. It is also desirable to eliminate the hazardous caustic used in today's commercial units.

Alternate processes, such as that described in U.S. Pat. No. 4,120,777, have been proposed which include the use of alternate conditioning agents such as soluble metal bicarbonates. However, such processes have generally not been adopted by the industry for a number of reasons. For example, proposed processes often increase the cost of extraction beyond reasonable levels by requiring the use of large amounts of agents or by reducing the rate at which tar sand can be processed. In addition, such processes are not readily adopted since they cannot be carried out in existing extraction facilities.

SUMMARY OF THE INVENTION

A process for tar sand extraction has been invented using a conditioning step comprising an alkali metal bicarbonate, an alkali metal carbonate and a liquid hydrocarbon with or without a source of calcium and/or magnesium ions.

According to a broad aspect of the present invention, there is provided a process for extraction of bitumen from tar sands comprising: providing a slurry including the tar sand, hot water, an alkali metal bicarbonate, an alkali metal carbonate and a liquid hydrocarbon; mixing and aerating the slurry to form a froth containing bitumen within the slurry; and, separating the froth from the slurry.

According to a further broad aspect of the invention, there is provided a process for using a hot water extraction apparatus having a transport pipe and a separation cell, the process comprising: mixing tar sand, hot water, an alkali metal bicarbonate, an alkali metal carbonate and a liquid hydrocarbon to form a slurry; moving the slurry along the transport pipe such that a froth containing bitumen is formed within the slurry; and separating the froth from the slurry in the separation cell.

According to a still further aspect of the present invention there is provided a process for using a hot water extraction apparatus having a slurry tumbler and a separation cell, the process comprising: in the tumbler, mixing and aerating a slurry including tar sand, hot water, an alkali metal bicarbonate, an alkali metal carbonate and a liquid hydrocarbon, such that a froth containing bitumen is formed within the slurry; passing the slurry to the separation cell; and separating the froth from the slurry in the separation cell.

Using the conditioning step of the present invention in a tar sands extraction allows a reduction in sludge production when compared to the present caustic in hot water extraction. The hot water extraction equipment presently in use can be used with the conditioning step of the present invention in an improved hot water extraction process. The conditioning step is also useful in modified hot water extraction equipment such as that equipment known as the hydrotransport system.

DETAILED DESCRIPTION OF THE INVENTION

An alkali metal carbonate (the carbonate), an alkali metal bicarbonate (the bicarbonate) and a liquid hydrocarbon are used with water to condition tar sand for quick release and flotation of the bitumen contained in the tar sand substantially without the production of waste sludge. The term waste sludge is used herein to define the sludge which is produced during the caustic/hot water extraction which will remain in a gel-like condition for many years. By use of the conditioning step of the present invention in a hot water extraction process, a waste slurry is produced comprising some trapped bitumen, sand and silt in water containing the bicarbonate and the carbonate. This slurry will begin to settle immediately upon resting and will settle to form a sediment layer and supernatant water in a short period of time. The supernatent water contains bicarbonate and carbonate and can be recycled for use in the hot water extraction process. The liquid hydrocarbon forms part of the recovered bitumen stream and can be separated by distillation for recycling back into the process.

The preferred alkali metal salts for use in the present invention are sodium and/or potassium bicarbonate and sodium and/or potassium carbonate. Since, at present, the sodium salts are less expensive than the potassium salts, preferably sodium bicarbonate and sodium carbonate are used in order to reduce the cost of the extraction process. The alkali metal salts can be used in solid form or as a prepared solution.

The carbonate salt and the bicarbonate salt are used in a ratio of from 95:5 to 5:95 (weight to weight). Where the tar sand or water or the mixture of the two to be used in the extraction have a pH lower than between about 8.0 to 8.5, the amount of carbonate used in the process is preferably increased relative to the amount of bicarbonate and where the water to be used has a pH higher than between about 8.0 to 8.5, preferably the amount of carbonate is reduced relative to the amount of bicarbonate. As an example, recycle water from previous caustic extractions has a pH of 8.5–8.7. When this recycle water, having a high pH, is used for extraction according to the present invention, the ratio of carbonate to bicarbonate is preferably 20:80 by weight.

While lower concentrations will act to condition tar sands, the bicarbonate in combination with the carbonate is preferably added in an amount of at least about 0.012% by weight of water. This represents a lower useful concentration since the addition of amounts below about 0.012% by weight reduce the effectiveness of the conditioning so that less satisfactory bitumen extraction occurs, in terms of economics. The upper levels of amounts of combined carbonate and bicarbonate added to the extraction also depend upon economics. The cost of the using higher concentrations of bicarbonate and carbonate must be weighed against the improvement in the level of conditioning and bitumen recovery. Generally, it has been found that the addition of amounts above 0.5% increase the cost of the process above reasonable levels, without greatly affecting the level of conditioning. Preferably, the bicarbonates and the carbonates are together added in a total amount of about 0.03% by weight of water. Preferably, the aqueous solution of bicarbonate and carbonate salts is added to the tar sand such that a consistency is obtained which will allow suitable mixing and froth floatation, such as, for example a solution to tar sand ratio of 0.5:1 to 5:1 by weight and preferably 1:1 to 1.5:1.

Preferably, the alkali metal salts are added to the water prior to the introduction of the water to the tar sand. Alternately, the alkali metal salts can be introduced directly to the tar sand or to the tar sand and water mixture. Regardless of the method of addition of the salts, the concentration of the salts in the tar sand and water mixture is generally about 0.004% to 0.50% by weight of the mixture and preferably about 0.015% by weight of the mixture.

The liquid hydrocarbon is preferably selected to have a high recovery from bitumen using available technologies. Any liquid hydrocarbon must be selected ensuring that bitumen is soluble in it. In addition, the liquid hydrocarbon preferably has a flash point, above about 80° C. and is non-toxic. The liquid hydrocarbon is a light hydrocarbon and is preferably heavy-naphtha and/or most preferably kerosene.

Any amount of liquid hydrocarbon added to the extraction process will assist in the recovery of bitumen. The liquid hydrocarbon is preferably added in an amount of 10% to 30% by weight of the amount of bitumen in the tar sand.

Any source of water can be used in the extraction process. Normally, the water source will be surface water, such as water from nearby lakes or rivers, and/or recycle water from previous extraction processes. It has been found that recycle water from tailings ponds which have previously stored caustic tailings can also be used with in the present invention.

It has been found that a total concentration of at least about 50 ppm of calcium and/or magnesium ions in the water used in the extraction process enhances the settling. While concentrations above about 50 ppm will act to enhance settling, concentrations above 200 ppm are preferred. The upper levels of useful calcium and/or magnesium ion concentrations depend upon economics. The cost of increasing the total ion concentration must be weighed against the improvement in the rate of settling. Generally, it has been found that concentrations above about 600 ppm increase the cost of the process, without greatly affecting the rate of settling. Preferably, water for use in the extraction process is monitored to ensure sufficient concentrations of calcium and/or magnesium ions are present. In an alternate preferred embodiment, an amount, for example, to provide a concentration of at least 50 ppm, of calcium and/or magnesium ions is added to the water used in the extraction process.

Since the recycle water used in hot water extraction does not normally contain the desired concentrations of calcium and/or magnesium ions, in another embodiment the conditioning solution comprises sodium and/or potassium bicarbonate, in combination with sodium and/or potassium carbonate and effective concentrations of a source of calcium and/or magnesium ions. Suitable sources of the ions are soluble calcium and/or magnesium salts which are suitable for use in the medium, such as gypsum. The conditioning solution is used such that the sodium and/or potassium bicarbonate in combination with sodium and/or potassium carbonate are added in a total amount of at least about 0.004% by weight of slurry and the total concentration of calcium and/or magnesium ions in solution is at least about 50 ppm.

Where greater control over the concentrations of each of the carbonate and bicarbonate ions and calcium and/or magnesium ions is required, the concentrations of each of these ions can be modified separately such as by separate addition of sodium or potassium bicarbonates or carbonates and sources of calcium and/or magnesium ions or solutions thereof to the slurry.

To effect conditioning of tar sands, the water used in the conditioning step is preferably heated to a temperature of between about 100° F. and 195° F., and most preferably about 180° F.

It has been found that the use of wetting agents, detergents and/or emulsifiers in the conditioning process inhibits the settling of the waste slurry and recovery of bitumen. Thus, such additives should not be present for optimum results although small concentrations can be tolerated.

The extraction process can proceed using traditional or modified processes, preferably without the addition of caustic. Existing extraction facilities having tumblers, or hydro transport pipes and settling tanks can be used. New small tailings settling sites can be constructed or existing tailing ponds can be used.

The extraction separates the bitumen from the water and sediments. Most and preferably all of the liquid hydrocarbon will be separated from the solution with the bitumen. Once the extraction has taken place, the water, containing the alkali metal salts in solution, and sediments are sent to the settling ponds. The settling ponds can be existing caustic-containing ponds, but preferably are ponds constructed for use in accommodating the water and sediments from the present process. The solution is freed within a few days, upon settling of the sediments. A portion of the solution will be trapped in the interstitial spaces of the settled sand and clay mixture in the pond.

In one embodiment, the solution is recycled to the process prior to its complete cooling. This is done by recycling the mid cell layer resulting from separation instead of passing it directly to the tailings pond. Such recycling can be carried out in various ways depending upon the degree of settling obtained during froth floatation and separation. The degree of settling is dependent on the residence time in the separation cell or cells and the grade of the tar sand treated. To provide for such recycling, in one embodiment, at least one recycle storage tank is provided which allows for settling of the mid cell layer without the use of the tailings ponds. The tank is used to store the mid cell layer from the separation step for a period of time which is only sufficient for settling to obtain conditioning solution which is suitable for recycle, but not sufficient for complete cooling of the conditioning solution. For example, the tank is preferably sized to accommodate several hours of throughput. The tank is preferably formed of carbon steel and is enclosed and insulated by any suitable insulating material, with consideration as to the temperature of liquid to be stored in the tanks. Alternately, where sufficient settling has occurred during residence time in the separation process, the conditioning solution is recycled directly to the process after removal from the separation tank. Lines carrying the recycle solution are preferably insulated to reduce heat transfer out of the recycle solution during transport. To enhance the conservation of heat energy in the recycle liquid, the entire tar sands apparatus including the tumblers or hydrotransport lines, separation cells and any lines extending therebetween can be insulated to reduce heat loss therethrough.

In an embodiment incorporating a single recycle tank, the mid cell layer is fed to the middle of the tank at a flow rate which does not create turbulence. Recycle liquid is drawn from the upper regions of the tank where sufficient settling has occurred. In an alternate embodiment, two or more tanks are provided such that each tank is filled in turn and time for settling is provided while the others are being filled. Recycle liquids are drawn from the tanks in which sufficient settling has occurred.

Sediments which accumulate in the storage tanks are periodically passed to the tailings pond where any remaining alkali metal salt solution in the sediments is freed within a few days, upon settling of the sediments. Preferably, the tanks are formed with a generally conical lower portion having a valve at the lower limit thereof to facilitate the removal of sediments.

The alkali metal salt solution can be used to wash oversize debris obtained by screening the slurry prior to entry into the settling tanks. Such chunks of debris contain bitumen on their surface which can be recovered by high pressure washing with the alkali metal salt solution described hereinbefore. The resultant wash water containing bitumen is sent to the separation cell for bitumen recovery.

BRIEF DESCRIPTION OF THE DRAWINGS

A further detailed, description of the invention will follow by reference to the following drawings of specific embodiments of the invention, which depict only typical embodiments of the invention and are therefore not to be considered limiting of its scope. In the drawings.

DETAILED DESCRIPTION OF THE PREFERRED EMBODIMENTS

Figure 1:
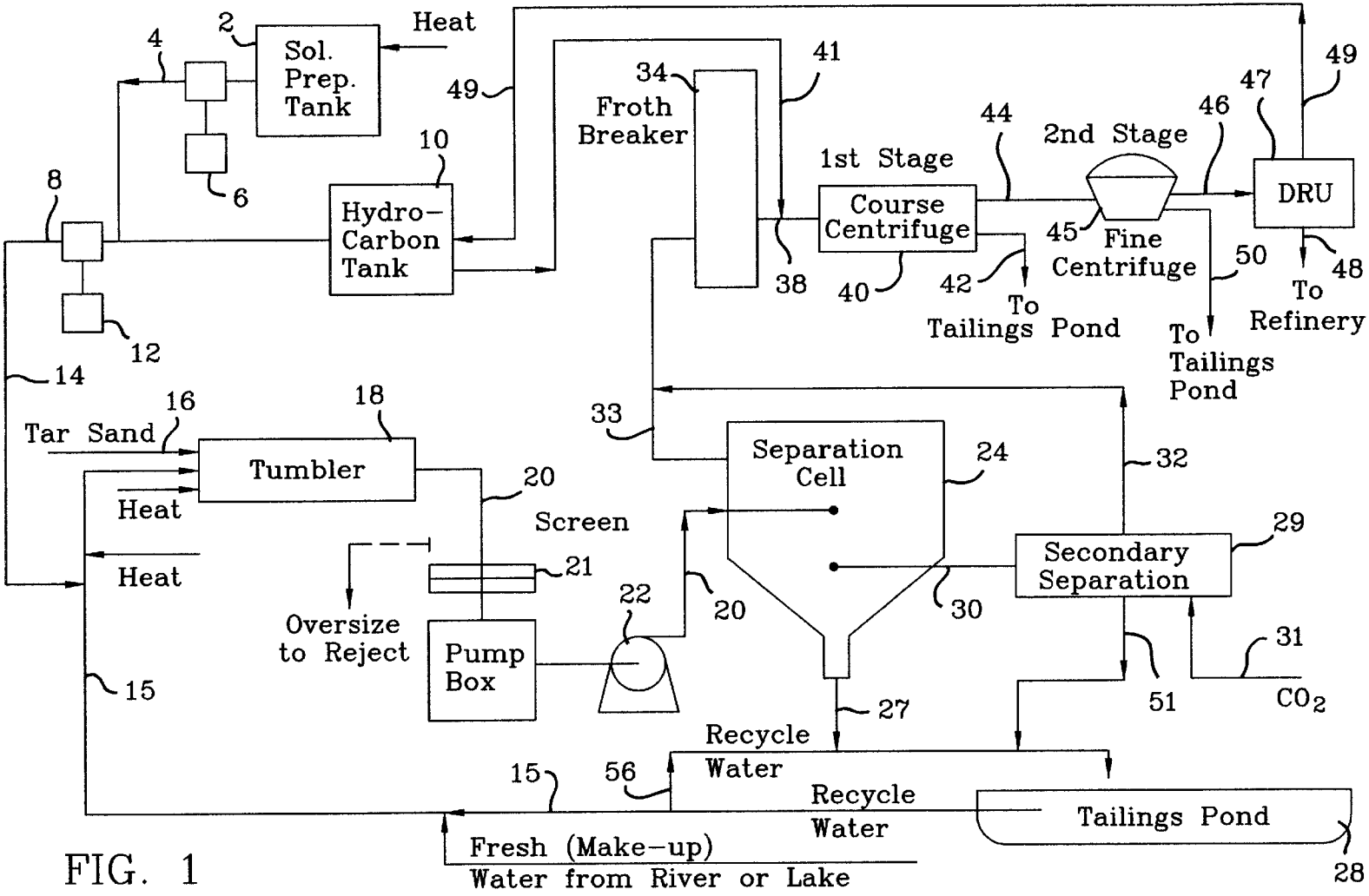
FIG. 1 is a schematic flow diagram of a hot water extraction process of the present invention.

Referring to FIG. 1, a flow diagram is shown depicting a hot water extraction process according to the present invention. The process can be carried out using conventional extraction facilities as are known and are as described hereinbefore. Water for use in the process is obtained from surface water sources such as nearby lakes or rivers and/or from tailings ponds. The tailings ponds are preferably those which have not been used in accommodating caustic tailings. A combination of water sources can also be utilized, as is shown.

Alkali metal solution comprising, in the preferred embodiment, sodium and/or potassium bicarbonate in combination with sodium or potassium carbonate in a ratio of from 95:5 to 5:95, the ratio being preferably selected as discussed hereinbefore with regard to the pH of the water to be used in the extraction, and soluble calcium and/or magnesium salts, such as gypsum, are mixed with water in a solution preparation tank 2 to form a concentrated solution. The concentrated solution is passed via a line 4 through proportioning pump 6 which acts to measure the required volume of concentrated solution to obtain the desired concentration of alkali metal salts in the water intended for use in conditioning the tar sand. In a preferred embodiment, where water from previous tar sand extraction processes in which the alkali metal salt solution was used, an amount of surface water can be added and the amount of concentrated solution added is preferably reduced to a minimum, for example 0.012% by weight of water. The volume of concentrated alkali metal salt solution as proportioned by pump 6 then continues via line 4. A line 8 extends from a solvent storage tank 10 wherein the liquid hydrocarbon is stored for use. The liquid hydrocarbon passes through line 8 and through a proportioning pump 12 which acts to measure the required volume of liquid hydrocarbon to be added to the tar sand extraction process. Preferably line 4 connects with line 8 at the suction port of pump 12 to enhance mixing of the solution and the liquid hydrocarbon. The alkali metal salt solution containing kerosene is then conducted via line 14 to be added to water passing in line 15. Preferably, the water in line 15, and any additives which are added to the water, such as the solution in tank 2 and the hydrocarbon in tank 10, are heated to a temperature of about 180° F. for use in the process.

The prepared solution continues along line 15 and is fed to tumbler 18 where it is mixed with tar sand, entering on conveyor 16, to form a slurry. Tumbler 18 causes the slurry to be aerated and mixed vigorously by means of steam injection and positive physical action, causing the bitumen to be stripped from the sand grains. This mixing also causes the slurry to be aerated. A bitumen froth is formed by the aeration of the bitumen during tumbling. The residence time of the slurry in the tumbling drum is not critical to the process, but should preferably be maintained at as low a level as reasonably possible to optimize throughput. The preferred residence time for any installation and tar sand quality can be determined by gradually increasing or decreasing residence time while noting the amount of oil recovered. This can be plotted to show what increase occurs with increased residence, and the value of the increased recovery can be plotted against the cost of increased residence time to find an economically useful residence time. As an example, using residence times which are presently used in large scale tar sand extraction, the slurry is treated in the tumbling drums for about 24 to 27 minutes. The residence time is increased, such as, for example to 26 to 29 minutes, where the tar sand is in the form of large lumps.

After tumbling, the slurry is passed via line 20 through screen 21 which removes larger debris. Line 20 continues through a pump 22 to separation cell 24 where settling time is provided to allow the slurry to separate into layers comprising froth, a mid cell layer and sediments. According to accepted tar sand extraction processes, suitable separation is provided by a residence time of 25 to 28 minutes. However, this residence time is not critical to the invention and can be adjusted on a cost-benefit analysis.

Sediments, including sand and/or silts, and some water from the separation cell are passed through line 27 to a tailings pond 28.

The mid cell layer, unlike the middlings produced by the traditional caustic hot water process, is not a stable sludge and requires considerably less time to settle than the caustic process middlings. A secondary separation cell 29 is, thus, not critical but such cells exist in conventional separation apparatus and can be used to advantage. Accordingly, after a shorter residence time in separation cell 24 (for example 18 to 20 minutes) and removal of any froth, a greater flow of mid cell layer, including the unsettled, and a portion of the settled, sediments from cell 24 can be fed via line 30 to secondary separation cell 29 which will act as an extension of separation cell 24 and will allow greater throughput in the system. In secondary separation cell 29, the mid cell layer is re-aerated or bubbled with carbon dioxide entering through line 31 to form a froth with residence time for separation.

The residence times listed in the preferred embodiment correspond with residence times presently in use in existing facilities. Since suitable concentrations of bicarbonate and carbonate ions and calcium and/or magnesium ions, in the extraction process enhance the settling of the slurry and, with the kerosene, also enhance the recovery of bitumen, it is believed that residence times in the tumbler and separation cells can be reduced by use of the process of the present invention thereby enhancing throughput in extraction facilities. However, it is to be understood that residence times are not critical to the invention and should be optimized by cost benefit analysis.

Froth resulting from separation cell 24 and secondary separation cell 29 is fed via lines 32 and 33, respectively, to a conventional froth breaker vessel 34. The froth contains the liquid hydrocarbon. In vessel 34, the froth is heated and broken. Thus, the addition of traditional diluting agents, for example naphtha, is not required. The resultant mixture is fed via line 38 to coarse centrifuge 40 where the bitumen is separated from the heavier solids and the bulk of the water. Preferably, to facilitate separation of the bitumen from the water and solids, an additional amount of liquid hydrocarbon, for example kerosene, is added via line 41 to the mixture passing in line 38. The amount of kerosene added can be adjusted in order to optimize the centrifugal separation.

The partially cleaned bitumen recovered from centrifuge 40 is sent via line 44 to fine centrifuge 45 for further cleaning. Thereafter, the bitumen is conducted via line 46 to a diluent recovery unit 47 (DRU) wherein the liquid hydrocarbon is distilled from the bitumen. The separated bitumen is then conducted via line 48 to a refinery storage for future upgrading. The separated liquid hydrocarbon is conducted via line 49 to solvent storage tank 10 for recycling into the extraction process. Although not shown, the amount of hydrocarbon which is fed to the centrifuge feed line 38 can be taken from line 49, rather than taking it from storage tank 10.

Sediments and solution from the bottom of separation cell 24, secondary separation cell 28 and centrifuges 40 and 46 are fed via lines 27, 42, 50, and 51 to tailings pond 52 where settling occurs and water containing alkali metal salts in solution is released. The released liquid has been found to have a concentration of alkali metal salts which is only slightly less than the initially introduced concentration and can be recycled back via line 15 for use in the initial conditioning of tar sand. In addition, recycle water can be fed via line 56 to the outlet 27 of separation cell 24, and the outlet 51 of secondary separation cell 28 to assist in the passage of sediments to the tailings pond 28. Additional use can be made of the released liquid for washing of oversize debris, as will be discussed in more detail below.

Figure 2:
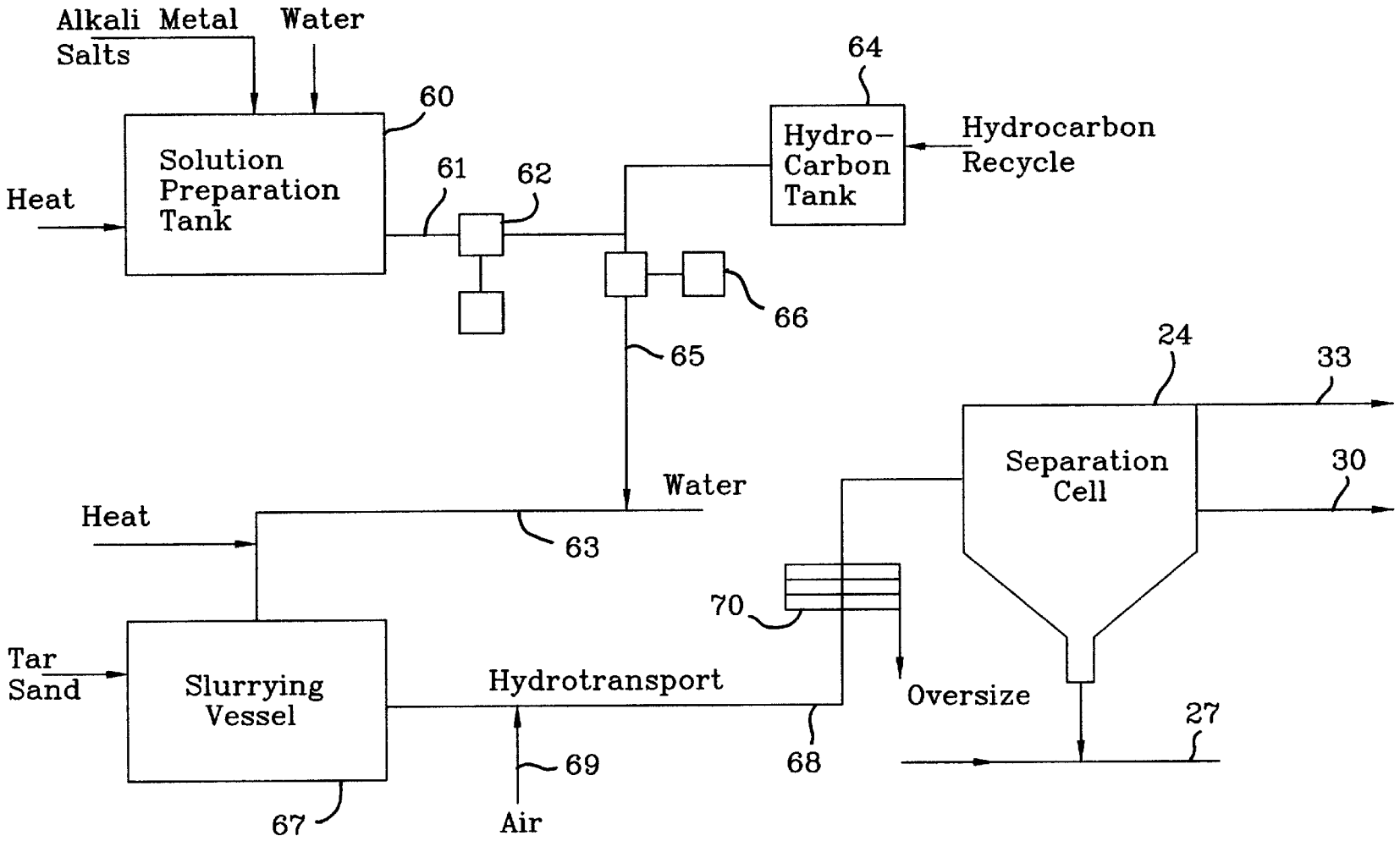
FIG. 2 is a schematic flow diagram of an alternative hot water extraction process of the present invention; and, FIG. 3 is a schematic flow diagram of another hot water extraction process of the present invention.

Referring to FIG. 2, a flow diagram is shown depicting an alternate tar sand water extraction process according to the present invention in equipment designed for the hydrotransport system. Alkali metal salts, for example sodium carbonate and sodium bicarbonate, and water are mixed in solution preparation tank 60. As discussed with reference to FIG. 1, water for use in the preparation of the concentrated alkali metal salt solution and for mixing with the tar sand can be surface water and/or recycle water. The concentrated solution is passed via a line 61 through proportioning pump 62 for eventual mixing with water passing via line 63 to form a alkaline metal salt solution of desired concentration. Additionally, liquid hydrocarbon, for example kerosene, is passed from a hydrocarbon storage tank 64 via line 65 through a proportioning pump 66 into line 63. Preferably, as shown, the solution from line 61 is connected for mixing with the hydrocarbon in line 65 at the suction port of pump 66. The hydrocarbon-containing alkali metal salt solution passes into slurrying vessel 67 where it is mixed with tar sand to form a slurry. Vessel 67 is preferably located at the mine site. The production of a slurry at the mine site allows for the transport of the slurry to the separation facility through a transport pipe 68. Thus, the need for transporting the tar sand, by means of trucking or conveyor systems, is avoided. Pipe 68 provides vigourous mixing of the slurry during transport, causing the bitumen to be stripped from the sand particles. Aeration can be provided along transport pipe 68, as shown at 69, and other points to assist in the conditioning of the tar sand and the formation of bitumen froth. The residence time in pipe 68 is dependent on the distance to be travelled. From pipe 68 the slurry is passed through screen 70 and on to separation cell 24 for further treatment as is described above in reference to FIG. 1.

Figure 3:
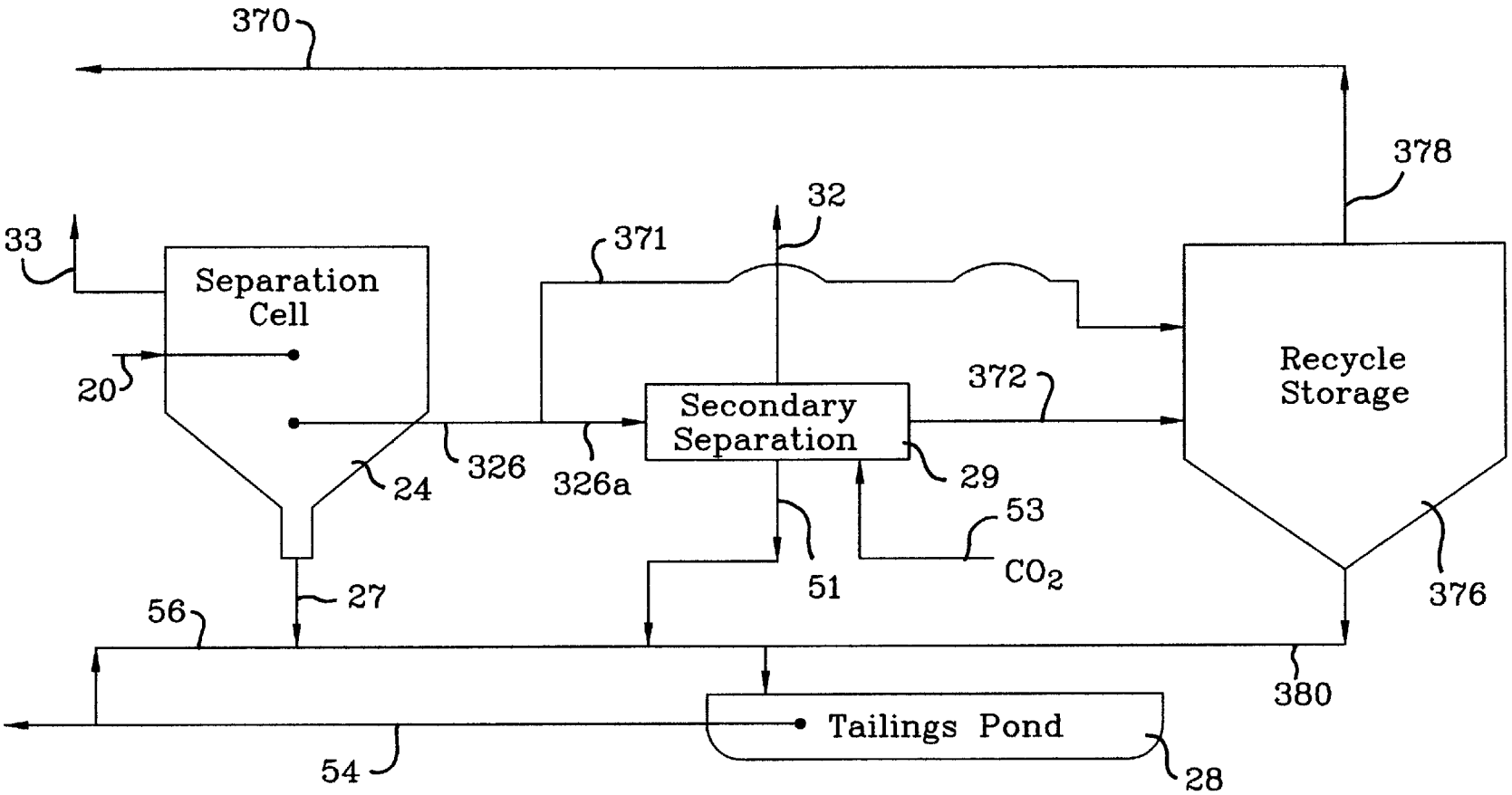

Referring to FIG. 3, there is shown another embodiment of a hot water extraction process of the present invention using direct recycling of conditioning solution prior to cooling of the solution. In such a process various recycling paths can be taken depending on the level of settling provided by residence times in the separation cell or cells. As discussed with reference to FIGS. 1 and 2, a slurry containing tar sand which has been conditioned by use of the hydrocarbon-containing alkali metal salt solution is fed via line 20 to separation cell 24 for froth floatation. Froth recovered in separation cell 24 is fed via line 33 for further treatment, as discussed in reference to FIG. 1. The remaining mid cell layer and sediments are treated according to the desired extraction process and the degree of the settling achieved by residence time in separation cell 24.

If secondary separation is not used, the mid cell layer from cell 24 can be passed via lines 326 and 371 to a recycle storage tank 376 for provision of residence time for settling of any remaining sediments.

If either insufficient settling has occurred in separation cell 24 or if it is desired that a secondary separation be used for further froth recovery, a greater flow of mid cell layer from separation cell 24, including a portion of the settled sediments, is passed from cell 24 via lines 326 and **326*a* to secondary separation cell 29. Froth from cell 29 is fed via line 32 for further treatment, as discussed in reference to FIG. 1. Sediments in separation cell 29 are passed via lines 51 and 56 to tailings pond 28. The remaining mid cell layer from cell 29 is passed via line 372 to tank 376 where residence time is provided for settling of sediments from the conditioning solution. After sufficient residence time is provided, the conditioning solution is recycled via lines 378 and 370 for use in conditioning of further tar sands. Sediments from tank 376 are passed via lines 380 and 56 to tailings pond 28 by flushing with a small amount of solution. Tank 376 and lines 20, 326, 326*a*, 370, 371, 372 and 378** are each insulated to reduce the transfer of heat energy from the conditioning solution.

In a preferred embodiment, tank 376 is an enclosed tank suitably sized to accommodate several hours of throughput. Input is fed to a middle region of the tank and recycle liquid is taken from the upper regions of the tank. In an alternate embodiment (not shown), two substantially identical tanks are used. In such an embodiment, the mid cell layer flow is directed to one of the tanks until it is filled. The filled tank is then given time to settle and recycle supply is taken from this tank while the second tank is being filled. The two tanks continue being alternately filled and emptied. Periodically, accumulated sediments are flushed from the tanks to the tailings pond.

The embodiments of the recycle lines from the primary and secondary separation cells and the insulated tank need not all be present in the same tar sand extraction facility as the presence of one or more of the lines or tank may not be required for the particular extraction being undertaken, depending on the residence times in the separation cells and the grade of tar sand which is treated. Alternately, the recycle lines and storage tank can all be present at all times and used as needed.

The invention will be further illustrated by the following examples. While the examples illustrate the invention, they are not intended to limit the scope of the invention.

EXAMPLE 1

All tar sand for the tests was obtained from a deposit in Trinidad and Tobago.

Separate extractions are carried out using for each test using a laboratory batch extraction unit (BEU). The experimental method varies slightly from the method used in large scale extraction by inclusion of an initial mixing step. This initial mixing step is carried out in the BEU but is not carried out in large scale processes because the BEU is not capable of providing the degree of mixing which is provided by large scale tumblers.

A BEU is charged with 150 ml of a solution of 0.05% (by weight of water) of sodium bicarbonate and sodium carbonate (8:2 parts by weight) at a temperature of 82° C. and 500 g of tar sand and an initial mixing is carried out for 10 minutes. A further 1000 ml of the solution at a temperature of 82° C. is charged to the BEU with an amount of kerosene, as indicated, at a temperature of 82° C. The contents of the BEU are mixed and aerated for 10 minutes. After mixing, all aeration and agitation is ceased and the primary froth is removed. The mixing is repeated for 10 minutes and the secondary froth is removed.

After treatment, the primary and secondary froth obtained from the extraction is analysed. All solids and water content values are expressed as a percent per volume as determined by centrifuging. Percent recovery is determined using laboratory analysis to determine bitumen content in both untreated sand and bitumen froth.

Results for five extractions are shown in Table 1.

TABLE 1

| TEST | AMT. OF KEROSENE | % SOLIDS | % WATER | % RECOVERY |
|---|---|---|---|---|
| T.T.S. 6 | 0 g | 49.9 | 25.8 | 97.8 |
| T.T.S. 7 | 0 g | 47.9 | 28.8 | 98.2 |
| T.T.S. 10 | 10 g | 24.2 | 43.2 | 98.5 |
| T.T.S. 15 | 10 g | 30.0 | 39.2 | 98.2 |
| T.T.S. 9 | 20 g | 12.7 | 49.2 | 98.3 |

EXAMPLE 2

The procedure of example 1 was repeated except that 10 grams of kerosene was used for each test and the temperatures of the solution and the kerosene were varied, as indicated, for each extraction.

TABLE 2

| TEST | TEMP. | % SOLIDS | % WATER | % RECOVERY |
|---|---|---|---|---|
| T.T.S. 15 | 82° C. | 30.0 | 39.2 | 98.2 |
| T.T.S. 14 | 70° C. | 38.8 | 33.2 | 98.5 |
| T.T.S. 12 | 60° C. | 44.2 | 31.7 | 97.5 |
| T.T.S. 11 | 50° C. | 48.8 | 28.8 | 93.8 |

EXAMPLE 3

The procedure of example 1 was repeated for test T.T.S. 27, 31, T.T.S. 28 32, T.T.S. 29 33 and T.T.S. 30 34 except that (i) tar sand from another site in Trinidad and Tobago was used for each test and the solution, (ii) the kerosene were each used at a temperature of 85° C. and (iii) the second mixing step was reduced to five minutes. In test T.T.S. 35 36 the procedure was as noted for the test T.T.S. 27 31 except that a solution of NaOH (0.02% by weight) was used instead of the bicarb/carb solution and kerosene. The data shown were average results from the data collected in two identical tests.

TABLE 3

| TEST | AMT. OF KEROSENE | % SOLIDS | % WATER | % RECOVERY |
|---|---|---|---|---|
| T.T.S. 27 31 | 10 g | 41.3 | 41.1 | 96.8 |
| T.T.S. 28 32 | 20 g | 20.4 | 52.1 | 94.7 |
| T.T.S. 29 33 | 30 g | 16.2 | 54.2 | 96.5 |
| T.T.S. 30 34 | 40 g | 16.4 | 48.9 | 97.3 |
| T.T.S. 35 36 | caustic | 43.6 | 36.1 | 92.9 |

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A process for extraction of bitumen from tar sands comprising:

providing a slurry including the tar sand, hot water, an alkali metal bicarbonate, an alkali metal carbonate and a liquid hydrocarbon;

mixing and aerating the slurry to form a froth containing bitumen within the slurry; and, separating the froth from the slurry.

2. The process as defined in claim 1 wherein the liquid hydrocarbon is kerosene.

3. The process as defined in claim 1 wherein the liquid hydrocarbon is added in an amount of 10% to 30% by weight of the amount of bitumen in the tar sand.

4. The process as defined in claim 1 wherein the alkali metal bicarbonate is selected from the group comprising sodium bicarbonate and potassium bicarbonate and an alkali metal carbonate is selected from the group comprising sodium carbonate and potassium carbonate.

5. The process as defined in claim 1 wherein the alkali metal bicarbonate and the alkali metal carbonate are added to the slurry in a total amount of at least about 0.004% by weight of slurry.

6. The process as defined in claim 1 wherein the alkali metal bicarbonate and the alkali metal carbonate are used in a ratio of 95:5 to 5:95 by weight.

7. The process as defined in claim 1 wherein the hot water is at a temperature of between about 100° F.–195° F.

8. The process as defined in claim 1 wherein the slurry further comprises a total concentration of at least about 50 ppm of calcium and/or magnesium ions.

9. The process as defined in claim 1 wherein the hot water comprises recycled water from a recycle storage tank.

10. The process as defined in claim 1 wherein after separating the froth from the slurry, the process further comprises:

re-aerating the slurry to form additional froth containing bitumen and separating the additional froth from the slurry.

11. The process as defined in claim 10 wherein after separating the additional froth from the slurry, the process further comprises:

recycling at least a portion of the hot water containing the alkali metal bicarbonate and the alkali metal carbonate for use in further extraction of bitumen from tar sand.

12. The process as defined in claim 1 wherein after separating the froth from the slurry, the process further comprises:

recycling at least a portion of the hot water containing the alkali metal bicarbonate and the alkali metal carbonate for use in further extraction of bitumen from tar sand.

13. The process as defined in claim 1 wherein after separating the froth from the slurry, the process further comprises:

bubbling the slurry with carbon dioxide to form additional froth containing bitumen and separating the additional froth from the slurry.

14. The process as defined in claim 13 wherein after separating the additional froth from the slurry, the process further comprises:

recycling at least a portion of the hot water containing the alkali metal bicarbonate and the alkali metal carbonate for use in further extraction of bitumen from tar sand.

15. The process as defined in claim 1 wherein the step of mixing is carried out in a tumbler.

16. The process as defined in claim 1 wherein the step of mixing is carried out in a transport pipe.

17. The process as defined in claim 1 wherein the water for use in the process is monitored to determine its total concentration of calcium and/or magnesium ions, a source of calcium and/or magnesium ions being added to the water to increase the total concentration to 50 ppm where the total concentration is found not to be 50 ppm.

18. The process as defined in claim 1 wherein a suitable amount of a source of calcium and/or magnesium ions is added to the slurry such that a total concentration of calcium and/or magnesium ions is increased by at least about 50 ppm.

19. The process as defined in claim 10 wherein the ions are present at a total concentration of 50 ppm to 600 ppm.

20. The process as defined in claim 1 wherein the slurry contains one part by weight of tar sand to each part by weight of water.

21. A process for extraction of bitumen from tar sands comprising:

providing a hot water extraction apparatus including a transport pipe and a separation cell;

mixing tar sand, hot water, an alkali metal bicarbonate, an alkali metal carbonate and a liquid hydrocarbon to form a slurry;

moving the slurry along the transport pipe such that a froth containing bitumen is formed within the slurry; and separating the froth from the slurry in the separation cell.

22. The process as defined in claim 21 wherein the liquid hydrocarbon is kerosene.

23. The process as defined in claim 21 wherein the liquid hydrocarbon is added in an amount of 10% to 30% by weight of the amount of bitumen in the tar sand.

24. The process as defined in claim 21 wherein the alkali metal bicarbonate is selected from the group comprising sodium bicarbonate and potassium bicarbonate and an alkali metal carbonate is selected from the group comprising sodium carbonate and potassium carbonate.

25. The process of claim 22 further comprising providing a recycle storage tank and passing the slurry to the recycle storage tank and providing for settling of the slurry to form sediments and a solution of the hot water, the alkali metal bicarbonate and the alkali metal carbonate and recycling at least a portion of the solution from the recycle storage tank for use in mixing with further tar sand.

26. A process for extraction of bitumen from tar sands comprising:

providing a hot water extraction apparatus including a slurry tumbler and a separation cell;

in the tumbler, mixing and aerating a slurry including tar sand, hot water, an alkali metal bicarbonate, an alkali metal carbonate and a liquid hydrocarbon to form a slurry, such that a froth containing bitumen is formed within the slurry; and passing the slurry to the separation cell and separating the froth from the slurry in the separation cell.

27. The process as defined in claim 26 wherein the liquid hydrocarbon is kerosene.

28. The process as defined in claim 26 wherein the liquid hydrocarbon is added in an amount of 10% to 30% by weight of the amount of bitumen in the tar sand.

29. The process as defined in claim 26 wherein the alkali metal bicarbonate is selected from the group comprising sodium bicarbonate and potassium bicarbonate and an alkali metal carbonate is selected from the group comprising sodium carbonate and potassium carbonate.

30. The process of claim 29 further comprising providing a recycle storage tank and passing the slurry to the recycle storage tank and providing for settling of the slurry to form sediments and a solution of the hot water, the alkali metal bicarbonate and the alkali metal carbonate and recycling at least a portion of the solution from the recycle storage tank for use in mixing with further tar sand.

* * * * *